United States Patent [19]

McCorkle

[11] 4,368,538

[45] Jan. 11, 1983

[54] SPOT FOCUS FLASH X-RAY SOURCE

[75] Inventor: Richard A. McCorkle, South Salem, N.Y.

[73] Assignee: International Business Machines Corporation, Armonk, N.Y.

[21] Appl. No.: 139,931

[22] Filed: Apr. 11, 1980

[51] Int. Cl.[3] ..... H05G 1/00

[52] U.S. Cl. ..... 378/122; 378/136

[58] Field of Search ..... 313/55, 56, 231.6, 231.7, 313/57, 58; 250/402, 493, 403; 315/111.2

[56] References Cited

U.S. PATENT DOCUMENTS

| | | | |
|---|---|---|---|
| 2,911,567 | 11/1959 | Fischer . | |
| 2,997,436 | 8/1961 | Little et al. . | |
| 3,113,917 | 12/1963 | Linhart . | |
| 3,138,729 | 6/1964 | Henke . | |
| 3,156,623 | 11/1964 | Baker . | |
| 3,172,000 | 3/1965 | Rosener, Jr. et al. . | |
| 3,225,245 | 12/1965 | Takei et al. . | |
| 3,259,773 | 7/1966 | Dyke et al. . | |
| 3,746,860 | 7/1973 | Shatas et al. | 250/402 |
| 4,042,848 | 8/1977 | Lee | 313/231.6 |
| 4,201,921 | 5/1980 | McCorkle | 250/493 |

OTHER PUBLICATIONS

Gilad et al., "High-Current-Density Relativistic Electron Beams in Conical Diodes", Appl. Phys. Lett., 34 (11), Jun. 1, 1979, pp. 731–732.

Post et al., "A 100 KV, Fast, High Energy, Nonuniform Field Distortion Switch", Rev. Sci. Inst., 43 (4), Apr. 1972, pp. 622–624.

*Primary Examiner*—Alfred E. Smith
*Assistant Examiner*—Carolyn E. Fields
*Attorney, Agent, or Firm*—Michael J. Weins; Yen S. Yee

[57] ABSTRACT

A high intensity spot focus soft X-ray source is described. The source produces a spectrum in the range from about 5 Å to 300 Å, with maximum power in the neighborhood of tens of angstroms. The flash intensity of the flash source is in the neighborhood of $10^{17}$ X-ray photons per flash. The source has an anode, and a cathode which is spaced apart from the anode and has a protrusion thereon. An insulating body having a passage therethrough is positioned between the anode and the cathode. The passage and the protrusion are axially aligned. At least one viewing port for the passage is provided. A means for maintaining the potential between the anode and the cathode allows the establishment of a potential between the same.

11 Claims, 6 Drawing Figures

FIG. 3.1

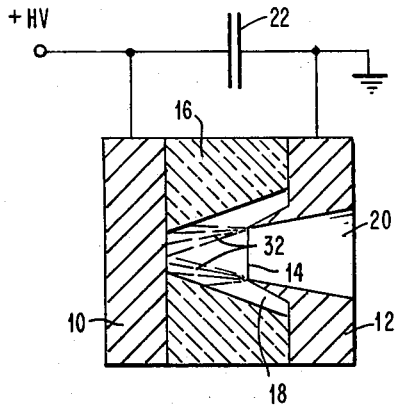
FIG. 3.2
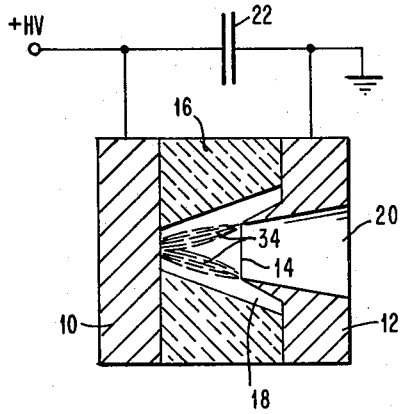
FIG. 3.3
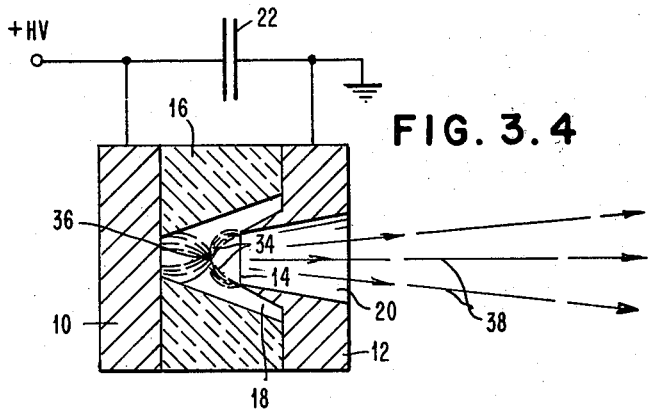
FIG. 3.4

SPOT FOCUS FLASH X-RAY SOURCE

DESCRIPTION

Technical Field

A flash X-ray generator which produces high intensity soft X-rays is described. More precisely, the generator is designed to produce a spot focussed, high intensity, high temperature plasma. The interaction of the plasma with the self-generated electron beam creates the soft X-rays.

Background Art

High intensity X-rays have been generated by other flash X-ray devices, however in general the X-ray spectrum produced by these earlier devices is heavily weighted towards the hard X-ray portion of the spectrum where the wavelengths less than 5 Å with the peak power generated at wavelengths of between about 2 to 0.5 Å. One flash X-ray device which produces intense hard X-rays is described by P. Gilad, E. Nardi, and Z. Zimamon in an article "High-Current-Density Relativistic Electron Beams and Conical Diodes", Appl. Phys. Ltrs. 34, (11), June 1979, pp. 731–732. This device operates with an electron beam which passes from the cathode to the anode and is focussed in an intense spot on the anode. In many respects this device is similar to earlier electron bombardment X-ray tubes with the exception that the power density of the electron beam is greater.

R. A. McCorkle in a copending application 927,238 filed Aug. 24, 1978, now U.S. Pat. No. 4,201,921, and assigned to the assignee of the present application discloses a device which provides an X-ray output from about 10 Å to 400 Å with the peak emissions in the 50–200 Å region.

BRIEF DESCRIPTION OF THE DRAWINGS

FIGS. 3.1–3.4 are pictorial representations of the steps associated with X-ray generation by the spot focus flash X-ray source.

DISCLOSURE OF INVENTION

It is an object of the present invention to produce an X-ray source that has its maximum intensity in the region of tens of Angstroms in wavelength.

It is another object of the invention to produce an X-ray source generating short bursts of X-rays.

Still another object of the invention is to produce an X-ray source which is tunable with respect to the maximum power output and peak emission wavelength wherein the tuning is accomplished by varying the power input to the X-ray source.

Yet another object of the invention is to produce an X-ray source which is tunable in wavelengths by the choice of the insulating materials used.

Another object of the invention is to produce a point source X-ray device.

These and other objects and advantages of the invention will become apparent from the following description, accompanying drawings and appended claims in which various novel features of the invention are more particularly set forth.

The X-ray device of the present invention has an anode, and a cathode which is spaced apart from the anode and has a protrusion thereon.

An insulating body having a passage therethrough is positioned between the anode and the cathode. The passage and the protrusion are axially aligned. At least one viewing port is provided to the passage. A means for maintaining the potential between the anode and cathode allows the establishment of a potential between the anode and cathode.

Best Modes of Carrying Out the Invention

Figure 1:
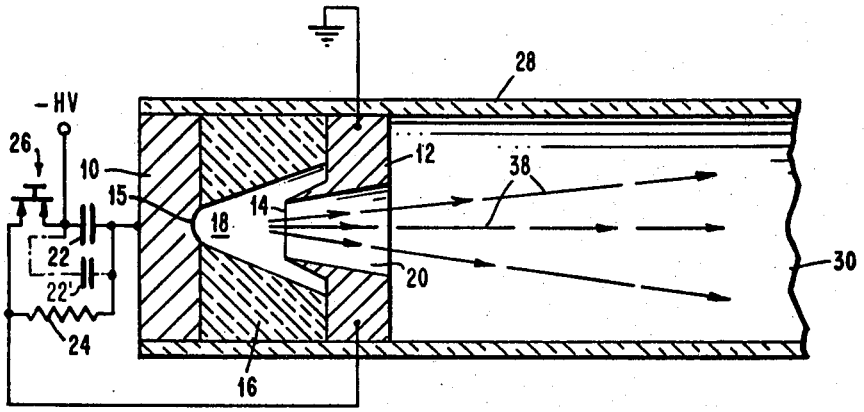
FIG. 1 is a pictorial representation of one embodiment of a spot focus X-ray source where one viewing port is provided.
Figure 1:
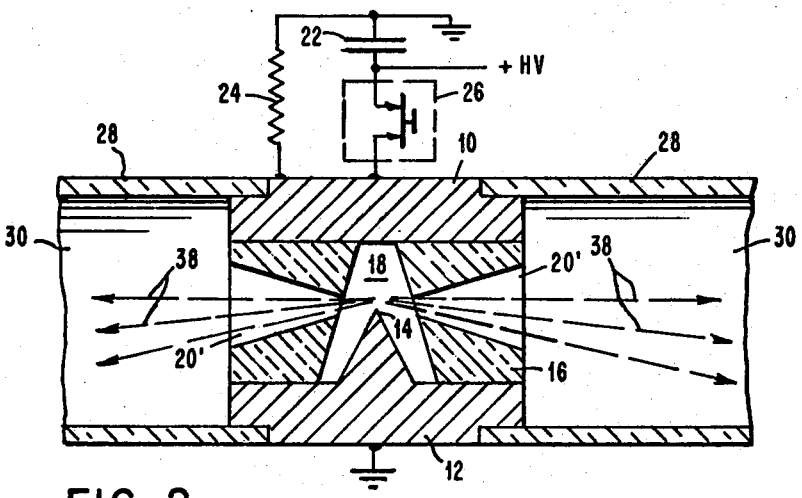

FIG. 1 is an illustration of one embodiment of the X-ray source of the present invention. An anode 10 is spaced apart from a cathode 12 which has a conical protrusion 14. The anode 10 and cathode 12 can be made of any conducting material but should be preferably a material that can withstand high temperatures such as tungsten, molybdenum, tungsten carbide, or a high density carbon. One example of a high density carbon is ACF 10Q poco carbon which is supplied by Union Oil Company. The anode 10 may contain a cavity 15 aligned with said conical passage. This cavity 15 aids in the stabilization of the focus point of the X-ray flash, as well as reduces erosion of the anode 10.

An insulating body 16 having a conical passage 18 therethrough separates the anode 10 and the cathode 12. The conical passage 18 is axially aligned with the conical protrusion 14. At least one viewing port 20 is provided to the conical passage 18. One preferred arrangement for the viewing port 20 is shown in FIG. 1. For this arrangement the viewing port 20 is axially aligned with the conical protrusion 14 and passes through the cathode 12. Employing this configuration assures maximum symmetry in the resulting device.

A capacitor 22 or other means may be employed to maintain a potential between the anode 10 and the cathode 12. It is preferred that the capacitor 22 be so located that its charge is symmetrically located with respect to the axis of the conical passage 18. While only a single capacitor 22 is shown to be connected between the anode 10 and the cathode 12, in fact multiple capacitors may be connected between said anode 10 and cathode 12 to maintain the potential therebetween.

Figure 2:
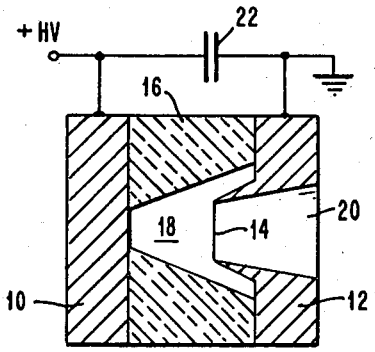
FIG. 2 is a pictorial representation of a second embodiment of a spot focus X-ray source where multiple viewing ports are provided.

Referring to FIG. 1, Capacitor 22 may thus include a capacitor 22' (shown in phantom) which is connected electrically in parallel forming said multiple capacitors. To further regulate the X-ray burst from the device additional control elements may be included. A highly resistive element 24 or other means for electrically connecting the cathode 12 to the anode 10 may be employed to allow electrical conduction between the elements during the charging cycle. This connection may be direct as illustrated in the FIG. 1 or may be through a common ground as is shown in FIG. 2. The resistance of the resistive element 24 must be sufficiently high that during discharge between the anode 10 and the cathode 12 the principal current is carried through the discharge.

If it is desired to selectively effect the discharge and thereby control its initiation then a triggering means between the capacitor 22 and the anode 10 is used to provide positive control of the discharge. A pressure switch 26 as described in "A 100 kV, Fast, High Energy, Nonuniform Field Distortion Switch", an article by R. S. Post and Y. G. Chen, The Rev. of Sci. Instr., Vol. 43, No. 4, (April 1972), pages 622–624, offers one such means to trigger the discharge between the anode 10 and the cathode 12. While a pressure switch is illustrated a mechanical switch could be substituted. With the capacitor 22, the resistive element 24, and switch 26 connected as shown in FIG. 1, the capacitor 22 can be charged by a negative voltage source. Any DC charging supply such as a battery or DC power supply will suffice.

The flash X-ray source is mounted in a container 28 so that the chamber 30 can be effectively evacuated, the evacuated chamber 30, facilitates discharge between the anode 10 and the cathode 12 and facilitates the transmission of the generated X-rays.

FIG. 2 is a schematic representation of a second embodiment to the present invention. Again, an anode 10 and a cathode 12 are employed. The cathode has a conical protrusion 14 thereon. Separating the anode 10 and the cathode 12 is an insulating body 16 with a conical passage 18. The conical passage 18 is axially aligned with the conical protrusion 14. In this embodiment the cathode 12 is solid and does not have a viewing passage therethrough. Viewing ports 20' are employed which are not axially aligned with the axis of conical passage 18 but are symmetrically disposed with respect to the axis of the conical passage 18. Moreover, the circuitry of FIG. 2 has been modified so that the trigger means is on the anode side of the capacitor 22. This arrangement will allow charging of the capacitor via a positive voltage source.

Operation of the flash X-ray source is illustrated in FIGS. 3.1 through 3.4. FIG. 3.1 shows the anode 10, and the cathode 12 with the insulating body 16 therebetween. A capacitor 22 is employed as the means for maintaining a potential between the anode 10 and the cathode 12. As illustrated in FIGS. 3.1–3.4 the device is self-triggering. When the potential between the anode 10 and the cathode 12 becomes sufficiently high cold emission of the electrons from the conical protrusions 14 of the cathode 12 occurs. This cold emission results in a spray of electrons 32 which impinge on the insulating body 16 as illustrated in FIG. 3.2. The energy delivered to the insulating body 16 by the electron spray 32 causes ablation of the walls of the passage 18 and aids in the formation of a plasma which fills the passage 18. The character of the resulting plasma will be determined in part by the composition of the insulator. Teflon $(CF_2)_n$ will result in a spectrum which includes the carbon and fluorine lines. These lines extend from about 11 Å to about 300 Å. Polyethelene $(C_2H_2)_n$ on the other hand will provide lines from about 25 Å to about 400 Å. Other spectra can be generated by the appropriate selection of the insulating material. If the line excited is to be a K-line then it is appropriate to select a material with at least one element with an atomic number less than 18.

It should be pointed out that P. Gilad's article discussed in the background art does not teach the use of an insulating body and thus does not produce an X-ray flux which peaks in the soft X-ray region of spectrum. While the device of McCorkle also discussed in the background art teaches a method of producing a soft X-ray spectrum it requires three electrodes and generates softer X-rays which are not as well suited for X-ray lithography and X-ray microscopy. As the current increases as a result of the contraction of the plasma the electron spray 32 is restricted and an electron beam 34 results as is illustrated in FIG. 3.3. As the current continues to increase the beam 34 continues to constrict and results in a focused plasma spot 36 as is illustrated in FIG. 3.4. It is this plasma spot 36 which provides the X-ray source and its interaction with the electron beam results in X-rays 38.

The impedance between the anode 10 and cathode 12 must be matched to the impedance of the circuitry which supplies the power. Moreover, it must allow sufficient current to pass between the anode 10 and cathode 12 to assure the formation of a spot focus 36. The impedance between the anode and cathode will be strongly influenced by the geometry of the anode 10, cathode 12 and the insulating body 16 therebetween, as well as the material employed.

It is preferred that the anode and cathode spacing be between 0.2 cm and 2 cm, this spacing being measured between the anode 10 and the termination of the protrusion 14. This spacing will assure currents which will allow filling within reasonable times of the conical passage 18 with plasma.

The maximum diameter of the protrusion should be between about 0.1 cm and 2 cm. This will assure sufficient focusing of the plasma to form an effective spot source.

The capacitor should be selected with a sufficient voltage ratio to maintain a potential of between about 20 kv. to about 500 kv. The capacity and intrinsic induction should be such as to provide a resultant current typically greater than about 10 kiloamps to about 100 kiloamps. This current should be applied over a pulse cycle of about 20 nanoseconds to about 200 nanoseconds. The product of the capacitance of the capacitor 22 and the resistance of the resistor 24 should be such that it is two orders of magnitude greater than the magnitude of the pulse time.

Industrial Applications

The device of the present invention produces high intensity pulses of X-rays. The output in each of these pulses will be in the neighborhood of $10^{17}$ X-ray photons per pulse. The X-ray pulses are powerful enough to allow diffraction patterns or absorption spectra to be obtained from a single shot which may typically last for 10's of nanoseconds. This allows the study of very short-lived structures such as intermediate species and chemical reactions. The X-rays are also of great use for lithography wherein mask patterns may be reproduced in a single pulse. Because of the shorter wavelength of the generated soft X-rays, they can be used to produce finer structures than can be generated by light patterns. These finer patterns are useful for microelectronic circuits.

Surface chemistry can also be studied employing soft X-rays. The device of the present invention will allow time-of-flight photo-electron spectroscopy and pulsed extended X-ray absorption spectroscopy. With such techniques time resolved surface film formation could be monitored.

The highly intense X-rays will be absorbed by the surface of some selected materials, and thus, by properly selecting the wavelengths to be interactive with the surface of the material, it is possible to impulse heat treat materials by flash X-ray techniques.

Having thus described my invention, what I claim as new, and desire to secure by Letters Patent is:

1. A flash X-ray source comprising:

an anode;

a cathode with a protrusion thereon;

an insulating body having a passage therethrough which is symmetrically disposed and axially aligned with said protrusion on said cathode, said insulating body being positioned between said anode and said cathode;

at least one viewing port for said passage; and means for maintaining a potential between said anode and said cathode.

2. The source of claim 1 wherein said passage and protrusion are conical in form and said protrusion having said viewing port therethrough, said viewing port being axially aligned with said conical protrusion.

3. The source of claim 1 wherein said passage is conical and multiple ports pass through the insulating body and are symmetrically disposed with respect to said conical passage.

4. The source of claim 1 wherein said anode and said cathode are carbon.

5. The source of claim 1 wherein said insulating body is Teflon $(CF_2)_n$.

6. The source of claim 1 wherein said means to maintain a potential between said anode and said cathode is a capacitor and further comprising:

means for electrically connecting said anode and said cathode allowing passage of a current to equalize the potential between said anode and said cathode during charging of said capacitor; and means for triggering a discharge between said anode and said cathode.

7. The source of claim 6 wherein multiple capacitors are employed to maintain a potential between said anode and said cathode and said capacitors symmetrically disposed and axially aligned with said passage and said means for electrically connecting said anode and said cathode is a resistor.

8. The source of claim 7 wherein said resistor has a resistance such that the product of the resistance of said resistor and the capacitance of said multiple capacitors is between about 2 microseconds and 20 microseconds.

9. The X-ray source of claim 1 wherein said insulating material has at least one element with an atomic number of less than eighteen.

10. The source of claim 1 wherein the maximum diameter of said protrusion is between about 0.1 cm and about 2.0 cm, and the anode and cathode spacing is between about 0.2 cm and 2.0 cm, where said spacing is measured between said anode and said protrusion.

11. The source of claim 1 wherein said passage and said protrusion are conical in form and said anode has a cavity which is aligned with said passage and said anode.

* * * * *